US010279214B2

(12) United States Patent
Chiang et al.

(10) Patent No.: US 10,279,214 B2
(45) Date of Patent: May 7, 2019

(54) EXERCISE APPARATUS

(71) Applicants: Hsin-Huang Chiang, Taichung (TW); Cheng-Kun Lee, Taichung (TW); Hsiang-Jung Chen, Taichung (TW); Shuo-Ying Lin, Taichung (TW); Joe Chen, Taichung (TW)

(72) Inventors: Hsin-Huang Chiang, Taichung (TW); Cheng-Kun Lee, Taichung (TW); Hsiang-Jung Chen, Taichung (TW); Shuo-Ying Lin, Taichung (TW); Joe Chen, Taichung (TW)

(73) Assignee: Johnson Health Tech Co., Ltd., Taichung (TW)

( * ) Notice: Subject to any disclaimer, the term of this patent is extended or adjusted under 35 U.S.C. 154(b) by 0 days.

(21) Appl. No.: 15/681,434

(22) Filed: Aug. 21, 2017

(65) Prior Publication Data

US 2019/0054343 A1 Feb. 21, 2019

(51) Int. Cl.

| | |
|---|---|
| ***A63B 21/02*** | (2006.01) |
| ***A63B 22/00*** | (2006.01) |
| ***A63B 23/12*** | (2006.01) |
| ***A63B 69/06*** | (2006.01) |

(52) U.S. Cl.

CPC ..... *A63B 22/0076* (2013.01); *A63B 21/023* (2013.01); *A63B 22/0087* (2013.01); *A63B 23/12* (2013.01); *A63B 69/06* (2013.01); *A63B 2022/0079* (2013.01)

(58) Field of Classification Search

CPC ... A63B 22/0076; A63B 22/008; A63B 23/12; A63B 69/06; A63B 2202/00; A63B 71/0054; A63B 2071/009; A63B 21/4031; A63B 21/4035; A63B 21/00061; A63B 21/02; A63B 21/023; A63B 21/0428; A63B 21/055; A63B 21/151; A63B 2208/0219

See application file for complete search history.

(56) References Cited

U.S. PATENT DOCUMENTS

| | | | | | |
|---|---|---|---|---|---|
| 4,846,460 | A * | 7/1989 | Duke | ..... | A63B 21/153 482/73 |
| 4,884,800 | A * | 12/1989 | Duke | ..... | A63B 21/154 482/73 |
| 5,072,929 | A | 12/1991 | Peterson et al. | | |
| 5,382,210 | A * | 1/1995 | Rekers | ..... | A63B 21/157 482/125 |

(Continued)

*Primary Examiner* — Garrett K Atkinson

(57) ABSTRACT

The present invention provides a multifunctional exercise apparatus for allowing a user to perform rowing exercise or other exercises. The exercise apparatus includes a frame, a sliding seat, a cord winder, a spiral spring connected to the cord winder, a cord connected to the cord winder, a flywheel for generating an exercise resistance, and one-way transmission mechanism connected between the cord winder and the flywheel. The user is able to seat on the sliding seat and slide backward and forward in accord with repeating movement of pulling the cord to perform the rowing exercise, or having lower limbs partially press upon the sliding seat and two hands grasp gripping portions at a front end of the frame to perform other exercises such as stretching exercises. When performing other exercises, a distal end of the cord is connected to the sliding seat and backward movement of the sliding seat would drive the flywheel.

16 Claims, 10 Drawing Sheets

(56) References Cited

U.S. PATENT DOCUMENTS

| | | | | |
|---|---|---|---|---|
| 5,876,052 | A * | 3/1999 | Olson | B62K 3/005 280/220 |
| 6,206,394 | B1 * | 3/2001 | Olson | B62K 3/005 280/220 |
| 6,817,968 | B2 * | 11/2004 | Galbraith | A63B 21/0552 482/121 |
| 9,687,401 | B2 * | 6/2017 | Alford | A63B 71/0619 |
| 9,764,185 | B2 * | 9/2017 | Lonergan | A63B 22/0076 |
| 2004/0009849 | A1 * | 1/2004 | Galbraith | A63B 21/0552 482/72 |
| 2005/0277521 | A1 * | 12/2005 | Lat | A63B 21/154 482/72 |
| 2015/0290061 | A1 * | 10/2015 | Stafford | A63B 71/0619 5/600 |
| 2017/0043208 | A1 * | 2/2017 | Lonergan | A63B 22/0076 |

* cited by examiner

EXERCISE APPARATUS

BACKGROUND

1. Field of the Invention

The present invention relates to an exercise apparatus. More particularly, the present invention relates to a multi-function exercise apparatus for allowing a user to perform rowing exercise, or the like.

2. Description of the Related Art

Rowing machine is a popular exercise apparatus nowadays, which is provided for allowing a user to simulate rowing motion (hereinafter, "rowing exercise"). The rowing machine is roughly divided into two types: one type of the rowing machine having a cord for allowing the user to repeatedly pull back and forward to the initial position, and the other type of the rowing machine having left and right rockers for allowing the user to repeatedly shake with two hands. In the case of the cord-type rowing machine, when the user performs a typical rowing exercise, the user is seated on a sliding seat and faces frontward, the feet are trodden on a pedal set, and the hands grasp a handle which is connected at the distal end of the cord. When the user's legs pedal straight to cause the body to slide backward along with the sliding seat and pull the handle backward at the same time, the cord is pulled to drive a cord winder to rotate in a forward rotational direction and further drive a rotating member (such as a flywheel, a wind resistance impeller or a water resistance impeller) of a resistance device to rotate via a one-way transmission mechanism. Then, when the user releases the force, the cord winder will be rotated by an elastic force of a spiral spring in a reverse rotational direction to wrap the cord back into the cord winder again for guiding the user and the sliding seat forward to the initial position, again and again.

In most of the cord-type rowing machine, the movement resistance is applied only to the aforementioned cord which is provided for allowing the user to pull. U.S. Pat. No. 5,072,929 discloses a rowing machine having two independent resistance mechanisms. The dual resistance is applied through a movable handle and a movable seat. The handle is interconnected by means or a cord to a first flywheel, and the seat is interconnected by means of a cord to a second flywheel, so that the backward movement of the handle and the backward movement of the seat respectively drive the first flywheel and the second flywheel. Besides, each resistance mechanism has a friction brake for adjusting the rotational resistance of the respective flywheel so as to adjust the resistances against the hands and legs during rowing exercise.

However, conventional rowing machines are usually only available for the user to perform the rowing exercise. The present invention has arisen to mitigate and/or obviate the disadvantages of the conventional method. Further benefits and advantages of the present invention will become apparent after a careful reading of the detailed description with appropriate reference to the accompanying drawings.

SUMMARY

The present invention is directed to an exercise apparatus for allowing a user to perform not only rowing exercise but also other exercises different to the movement of the rowing exercise.

According to one aspect of the present invention, an exercise apparatus for allowing a user to perform rowing exercise comprises a frame, a sliding seat, a pedal set, a cord receiving device, a resistance device, a one-way transmission mechanism and a handle. The sliding seat has at least one connecting portion. The sliding seat is adapted to be moved along a movement path, the movement path defining a front end and a rear end. When the user performs the rowing exercise, the user is seated on the sliding seat and faces frontward. The pedal set is mounted on the frame for supporting the user's feet during the rowing exercise. The cord receiving device has a cord winder, an elastic member and a cord. The cord winder is rotatable in both directions with respect to the frame. The elastic member is mounted between the frame and the cord winder, the elastic member being deformed by rotational movement of the cord winder in a first rotational direction to accumulate an elastic restoring force, and such elastic restoring force causing the cord winder to rotate in a second rotational direction. The cord has a first end and a second end, the first end connected to the cord winder, the cord being wound onto the cord winder as the cord winder is rotated in the second rotational direction. The elastic member is mounted between the frame and the cord winder, the first end of the cord is connected to the cord winder. The resistance device has a rotating member pivotally mounted to the frame for generating an exercise resistance. The one-way transmission mechanism is mounted between the cord receiving device and the rotating member of the resistance device. When the cord winder is rotated in the first rotational direction, the one-way transmission mechanism is effective to transmit power to the rotating member for driving the rotating member to rotate in a predetermined rotational direction. When the cord winder is rotated in the second rotational direction, the one-way transmission mechanism is ineffective to transmit power to the rotating member. The handle is connected to the second end of the cord for allowing the user to grasp during the rowing exercise.

Specifically, the second end of the cord is operable to connect with the connecting portion of the sliding seat. Furthermore, the frame has at least one gripping portion. The exercise apparatus is also provided for allowing the user to perform other exercises. When the user performs other exercises, the user has lower limbs partially press upon the sliding seat and move with the sliding seat. When the sliding seat is slid to one end of the movement path, the sliding seat pulls the cord to drive the cord winder to rotate in the first rotational direction, and the one-way transmission mechanism is effective to transmit power to the rotating member so as to drive the rotating member to rotate in the predetermined rotational direction, and the gripping portion is provided for allowing the user to grasp during other exercises.

Preferably, when the user performs other exercises, the second end of the cord is detachably connected to the connecting portion of the sliding seat, and the cord is extended forward from the sliding seat to the cord winder, such that when the sliding seat is slid backward, the cord is pulled to drive the cord winder to rotate in the first rotational direction. The handle is detachably connected to the second end of the cord; when the second end of the cord is connected to the connecting portion of the sliding seat, the handle is temporarily detached from the second end of the cord.

Preferably, the resistance device further comprises a resistance adjusting mechanism for allowing the user to adjust rotational resistance of the rotating member.

Further benefits and advantages of the present invention will become apparent after a careful reading of the detailed description with appropriate reference to the accompanying drawings.

DETAIL DESCRIPTION

Figure 1:
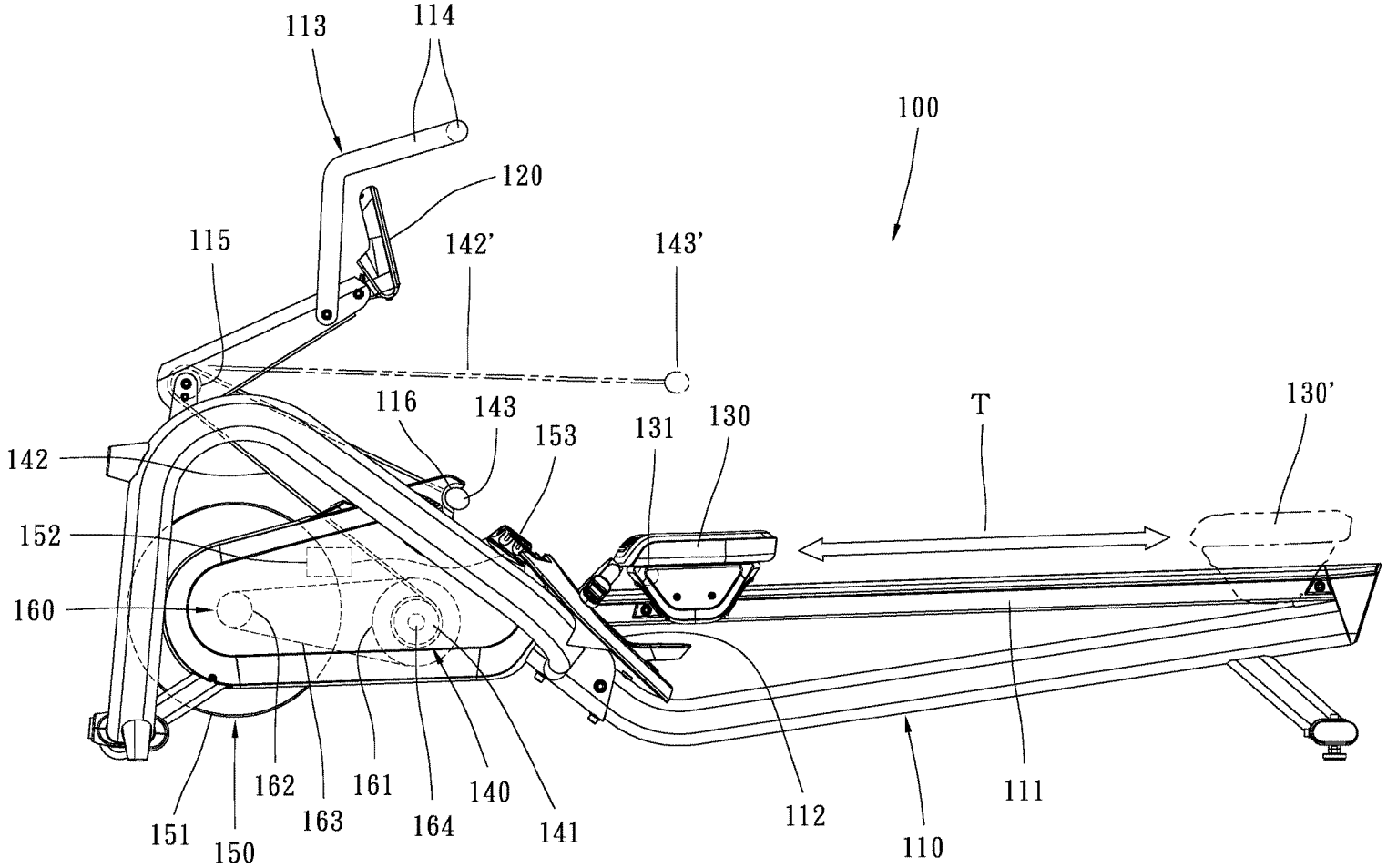
FIG. 1 is a side view of an exercise apparatus in accordance with a first preferred embodiment of the present invention.

Referring to FIG. 1, an exercise apparatus 100 in accordance with a first preferred embodiment of the present invention is similar to a typical cable rower, which comprises a frame 110, a sliding seat 130, a cord receiving device 140, a resistance device 150 and a one-way transmission mechanism 160.

The frame 110 is adapted to rest on a floor, which has a guide rail 111 extended longitudinally. The sliding seat 130 is slidably mounted on the guide rail 111, so that the sliding seat 130 is slidable along the guide rail 111 between its front end and rear end. In other words, the sliding seat 130 is able to be moved along a movement path which has a front end and a rear end on the frame 110. As shown in FIG. 1, the sliding seat 130 depicted by a solid line corresponds to the front end of the guide rail 111, and the sliding seat 130 depicted by a phantom line corresponds to the rear end of the guide rail 111 so as to represent the maximum range of motion of the sliding seat 130. When a user exercises on the exercise apparatus 100, the sliding seat 130 may slidably reciprocate in different sections of the guide rail 111 depending on the user or movement mode. The top surface of the sliding seat 130 is about 40 cm from the floor, which is slightly lower the knee height of an ordinary person who stands on the floor. In the preferred embodiment, the rear end of the guide rail 111 is slightly higher than the front end (tilted about 2 degrees), so that the sliding seat 130 is normally slid forward to the front end of the guide rail 111 when no external force is applied. In another embodiment of the present invention, the movement path of the sliding seat may be more level or more inclined.

The cord receiving device 140 is mounted on the front part of the frame 110. The cord receiving device 140 has a cord winder 141, at least one elastic member (not shown) and a cord 142. The cord winder 141 is pivotally mounted to the frame 110. The cord winder 141 could be rotatable in both directions with respect to the frame 110. The elastic member is mounted between the frame 110 and the cord winder 141. The elastic member and the cord winder 141 are coupled to each other. The elastic member could be deformed by rotational movement of the cord winder 141 in a first rotational direction (the counterclockwise direction in the figure) to accumulate an elastic restoring force (or elastic force hereinafter), such elastic restoring force causes the cord winder 141 to rotate in a second rotational direction (the clockwise direction in the figure). The cord 142 has a first end connected to the cord winder 141 and an opposite second end (or distal end hereinafter). A partial length of the cord 142 near the front end is previously wound around the outer periphery of the cord winder 141 in accordance with the first rotational direction. After the cord 142 is wound a few loops around the cord winder 141, the cord 142 extends forward from the outer periphery of the cord winder 141, and then extends rearward around a front pulley 115 that is pivotally mounted on the front end of the frame 110.

Therefore, when the distal end of the cord 142 is pulled back by a sufficient external force, the cord winder 141 is rotated correspondingly in the first rotational direction to release the partial length of the cord 142. When the external force applied to the distal end of the cord 142 is released or reduced to less than the elastic force of the elastic member, the cord winder 141 can be rotated by the elastic force in the second rotational direction so as to wrap the partial length of the cord 142 into the cord winder 141. Preferably, the aforementioned elastic member is arranged to have a suitable pre-deformation so that the cord winder 141 is forced by the elastic force all the time, namely the cord winder 141 has a tendency to rotate in the second rotational direction throughout, even if the cord 141 is wrapped to the end.

In the preferred embodiment, the aforementioned elastic member is a spiral spring. The spiral spring has an inner end and an outer end respectively embedded in the frame 110 and the cord winder 141, such that the spiral spring is able to be deformed by rotational movement of the cord winder 141 in the first rotational direction. In other embodiment of the present invention (not shown), the elastic member may be an extension spring, such extension spring has one end connected to the frame and the other end connected to a first end of a connecting cable which is inelastic. The connecting cable has a second end connected to the cord winder (or a circular part rotated synchronously with the cord winder), so that the rotational movement of the cord winder (or the circular part) in the first rotational direction will wrap the connecting cable to pull the extension spring. In another embodiment of the present invention (not shown), the elastic member may be an elastic rope, such elastic rope has one end connected to the frame and the other end connected to the cord winder (or a circular part rotated synchronously with the cord winder), so that the rotational movement of the cord winder (or the circular part) in the first rotational direction will wrap the elastic rope to increase the tension of the elastic rope.

As shown in FIG. 1, the distal end of the cord 142 is connected with a rod-shaped handle 143 for allowing the user to grasp. When the exercise apparatus 100 is not used, the handle 143 is able positioned in a handle receiving groove 116. Since the cord winder 141 is always forced by the elastic member to draw the cord 142 as much as possible, the handle 143 is able to be retained in the handle receiving groove 116 by the forward pulling force of the cord 142 and the distal end of the cord 142 also stops retracting at the same time. The user can grasp the handle 143 to pull the distal end of the cord 142 backward away from the handle receiving groove 116 and continuing away from the front pulley 115, as the cord 142' and handle 143' depicted by a phantom line in FIG. 1.

The aforementioned resistance device 150 is also arranged on the front part of the frame 110. The resistance device 150 mainly has a rotating member 151 pivotally mounted on the frame 110 for generating an exercise resistance while rotating. In other words, the user must apply force to drive the rotating member 151 while exercising on the exercise apparatus 100. In the preferred embodiment, the resistance device 150 further has a resistance adjusting mechanism 152 for allowing the user to adjust rotational resistance of the rotating member 151. In particular, the rotating member 151 in the preferred embodiment is a flywheel with a predetermined diameter and weight for generating a predetermined rotational inertia while rotating. The resistance adjusting mechanism 152 is an eddy current brake (ECB) that matches the flywheel 151. (Note: ECB is a conventional mechanism that is well known in the art, which is simply indicated by a box in the figures.) The user is able to control the resistance adjusting mechanism 152 via an adjustment knob 153 that is mounted on the frame 110, for example, mechanically controlling the permanent magnet of the ECB to move toward or away from the flywheel 151, or electrically controlling the magnetic field intensity of the electromagnet of the ECB to increase or decrease the rotational resistance if the flywheel 151. In other embodiments, the rotating member of the resistance device may use wind resistance impeller or water resistance impeller with resistance adjusting mechanism for adjusting the wind resistance or water resistance.

The one-way transmission mechanism 160 is arranged between the cord winder 141 of the cord receiving device 140 and the rotating member/flywheel 151 of the resistance device 150. When the cord winder 141 is rotated in the first rotational direction, the one-way transmission mechanism 160 is effective to transmit power to the flywheel 151 for driving the flywheel 151 to rotate in a predetermined rotational direction (as the counterclockwise direction in the figure). When the cord winder 141 is rotated in the second rotational direction, the one-way transmission mechanism 160 is ineffective to transmit power to the flywheel 151. In the preferred embodiment, the one-way transmission mechanism 160 has a first driving wheel 161, a second driving wheel 162, a driving belt 163 and a one-way bearing 164. The first driving wheel 161 is pivotally mounted to the frame 110 and coaxial with the cord winder 141, but the first driving wheel 161 and the cord winder 141 are able to rotate relative to each other. The second driving wheel 162 is coaxially connected to the flywheel 151, both of which are rotated synchronously. The first driving wheel 161 and the second driving wheel 162 each is substantially a pulley and the diameter of the first driving wheel 161 is greater than that of the second driving wheel 162. The driving belt 163 is mounted around the first driving wheel 161 and the second driving wheel 162, such that the first driving wheel 161 and the second driving wheel 162 are rotated synchronously, and the rotational speed of the second driving wheel 162 is greater than the rotational speed the first driving wheel 161, at a predetermined magnification. The one-way bearing 164 is mounted between the cord winder 141 and the first driving wheel 161, such that the cord winder 141 is able to rotate freely with respect to the first driving wheel 161 in the second rotational direction (the clockwise direction in the figure), but it cannot rotate in the first rotational direction (the counterclockwise direction in the figure) with respect to the driving wheel 161.

Under this arrangement, when the distal end of the cord 142 is pulled by a sufficient external force to drive the cord winder 141 to rotate in the first rotational direction, unless the first driving wheel 161 is rotating at a faster rotational speed according to the first rotational direction, the cord winder 141 forces the first driving wheel 161 to rotate synchronously through the one-way bearing 164, and the second driving wheel 162 is driven to rotate faster in the first rotational direction together with the flywheel 151. In contrast, when the cord winder 141 is forced by the elastic force of the elastic member to rotate in the second rotational direction, the first driving wheel 161 is not influenced by the rotational movement of the cord winder 141, namely, the first driving wheel 161, the second driving wheel 162 and the flywheel 151 may continue to rotate in the first rotational direction or remain stationary, and will not rotate in the second rotational direction. In the preferred embodiment, if the one-way bearing 164 is changed to arranged between the second driving wheel 162 and the flywheel 151, and the first driving wheel 161 is rotated synchronously with the cord winder 141, it can also achieved the same purpose.

In addition to the aforementioned belt transmission, the one-way transmission mechanism may use chain transmission. For example, the first driving wheel is a large chain sprocket with more teeth, the second driving wheel is a small chain sprocket with fewer teeth, and the driving belt is replaced by an endless chain belt. Furthermore, the one-way transmission mechanism may also use gear transmission. For example, the first driving wheel and the second driving wheel are large and small gears that are engaged with each other, or at least one intermediate gear arranged therebetween.

In the preferred embodiment, the exercise apparatus 100 further comprises an interface device 120 disposed on the top of the front end of the frame 110, and a detector (not shown) for detecting angular displacement of the cord winder 141. When the user exercises on the exercise apparatus 100, the detector transmits the signal of the angular displacement to a processor inside the interface device 120. At the same time, the resistance adjusting mechanism 152 also transmits the signal of resistance level to the processor. After processing by the processor, the information such as time, distance, stroke, calories could be displayed on a display that disposed on the front side of the interface device 120 for displaying to the user.

Figure 2A:
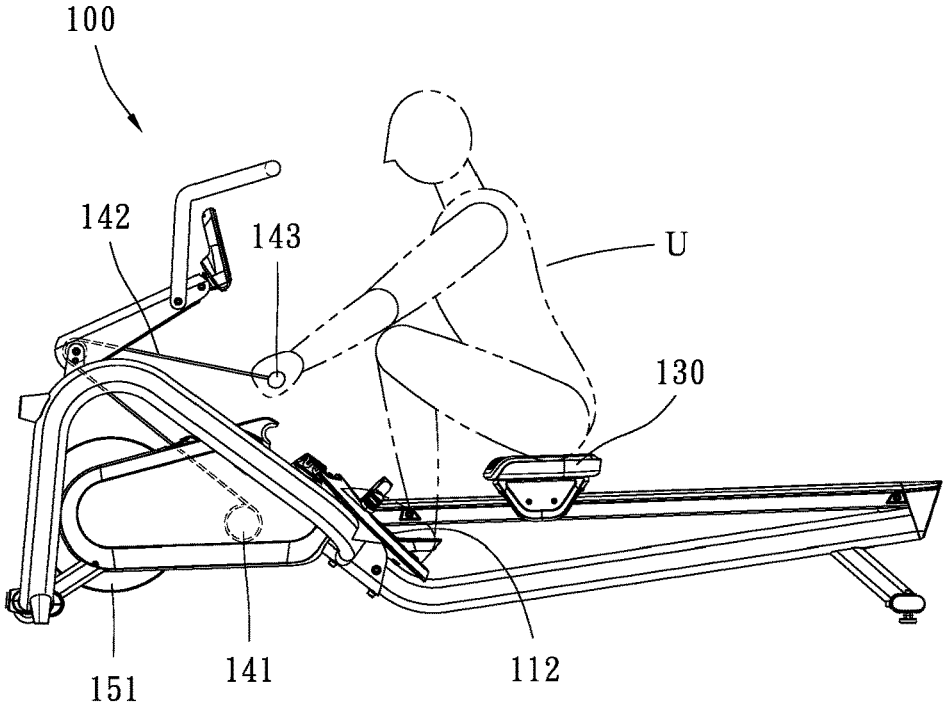
FIG. 2A and FIG. 2B illustrate a user performing a rowing exercise (first exercise) with the exercise apparatus in the first preferred embodiment.
Figure 2B:
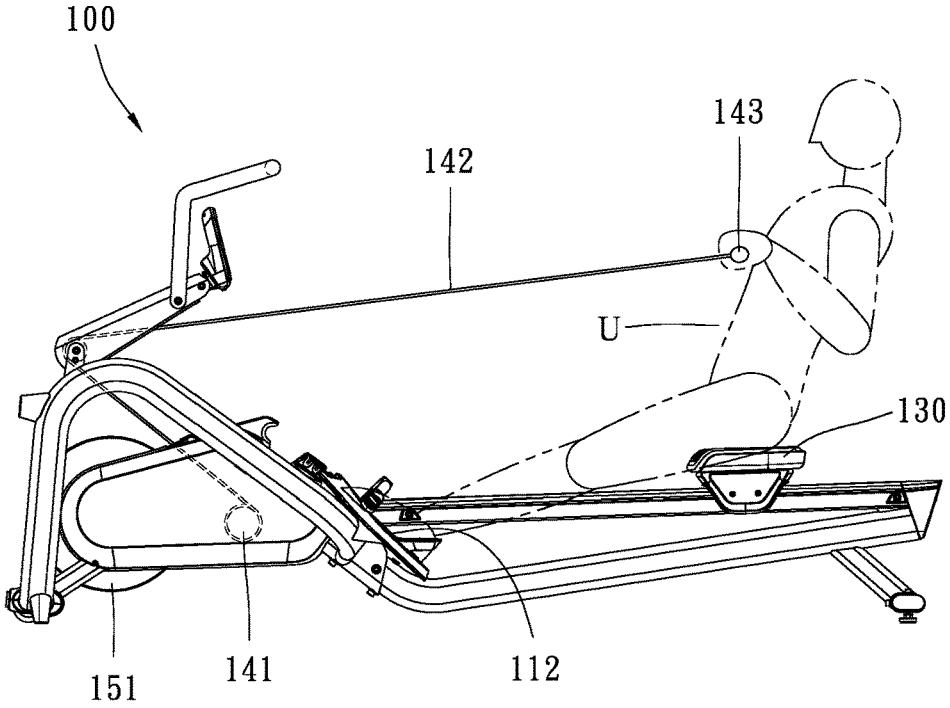

Referring to 2A and 2B, the exercise apparatus 100 is provided for allowing a user U to perform rowing exercise. When the user U performs the rowing exercise, the user is seated on the sliding seat 130 and faces frontward, and the feet are trodden on a pedal set 112 which is mounted on the frame 110 near the front end of the guide rail 111, and the hands grasp the handle 143 which is connected at the distal end of the cord 142. As the motion changes from FIG. 2A to FIG. 2B, when the user's legs pedal straight to cause the body to slide backward along with the sliding seat 130 and pull the handle 142 backward at the same time, the cord 142 is pulled to drive the cord winder 141 to rotate in the first rotational direction (the counterclockwise direction in the figure) and further driving the flywheel 151 to rotate via the one-way transmission mechanism 160. Then, as the motion changes from 2B back to 2A, when the user releases the force, the cord winder 141 will be rotated by the elastic force in the second rotational direction (the clockwise direction in the figure) to wrap the cord 142 back into the cord winder 141 again, guiding the user and the sliding seat 130 forward to reposition, again and again.

Referring back to FIG. 1, the exercise apparatus 100 in the preferred embodiment of the present invention has a holding frame 113 mounted at the top of the front end of the frame 110. The holding frame 113 has a plurality of gripping portions 114 which can be grasped by both hands or one hand, such as a cross bar extending in a left-and-right direction or a cross bar extending longitudinally. The height of the aforementioned gripping portions 114 is set at a height substantially corresponding to the waist to the chest portion of an ordinary person who stands on the floor. In another embodiment of the present invention, the holding frame 113 or gripping portions 114 may be designed to be adjustable in height, position and/or orientation, so that the user is able to adjust the gripping portions 114 in an optimum position according to the personal condition or the movement mode. On the other hand, the front end of the sliding seat 130 is provided with a connecting portion 131 which is located below the top surface of the siding seat 130 but higher than the top surface of the guide rail 111 of the frame 110. Please refer to FIG. 3A, the second end of the cord 142 is detachably connected to the connecting portion 131 of the sliding seat 130. In the connected state, the cord 142 extends forward from the sliding seat 130 to the front pulley 115 and then extends rearward around the front pulley 115. Since the cord winder 141 is forced by the elastic force of the elastic member to wrap the cord 142 all the time, the sliding seat 130 is pulled to stop at the front end of the guide rail 111 while no external force is applied. When the sliding seat 130 is pulled by a sufficient external force to slide backward and pull the cord 142 to drive the cord winder 141 to rotate in the first rotational direction, such power is able to transmit to the rotating member/flywheel 151 of the resistance device 150 via the aforementioned one-way transmission mechanism 160 so as to drive the flywheel 151 to rotate in the predetermined rotational direction (as the counterclockwise direction in the figure). When the external force applied to the sliding seat 130 is released or reduced to less than the elastic force of the elastic member, the sliding seat 130 is moved forward to reposition.

In the preferred embodiment, the handle 143 is detachably connected to the distal end of the cord 142. The handle 143 is able to be detached from the distal end of the cord 142 temporarily when the distal end of the cord 142 is connected to the connecting portion 131 of the sliding seat 130 as mentioned previously. For example, the distal end of the cord 142 can be directly connected with a safety hook such as carabiner (not shown) in practice. Correspondingly, the handle 143 has a connecting ring (not shown) mounted on the central position thereof, and the connecting portion 131 of the sliding seat 130 is substantially a connecting ring as well. Therefore, the safety hook of the distal end of the cord 142 is usually attached to the connecting ring of the handle 143 such that the handle 143 is connected at the distal end of the cord 142, if necessary, the handle 143 is able to be detached from the cord 142 and then the safety hook of the distal end of the cord 142 could be connected to the connecting portion 131 of the sliding seat 130. In another embodiment, the distal end of the cord may be connected to the connecting portion of the sliding seat together with the handle.

Under this arrangement, in addition to the aforementioned rowing exercise (first exercise), the exercise apparatus 100 is also provided for allowing the user to perform other exercises (such as stretching exercises) which are unlike movement of the rowing exercise. Before performing other exercises, the distal end of the cord 142 should be connected to the connecting portion 131 of the sliding seat 130 first, so that the user has to apply force to overcome the rotational resistance of the rotating member/flywheel 151 and the elastic force of the elastic member to push the sliding seat 130 backward. Also, when the sliding seat 130 slides forward, it is necessary to apply a suitable force against the elastic force of the elastic member for controlling the forward speed of the sliding seat 130. Like rowing exercise that the exercise resistance is adjustable, the user is able to adjust the rotational resistance of the rotating member/flywheel 151 by the adjustment knob 153 namely the sliding resistance of the sliding seat 130, thereby determining the difficulty of the movement.

Figure 3A:
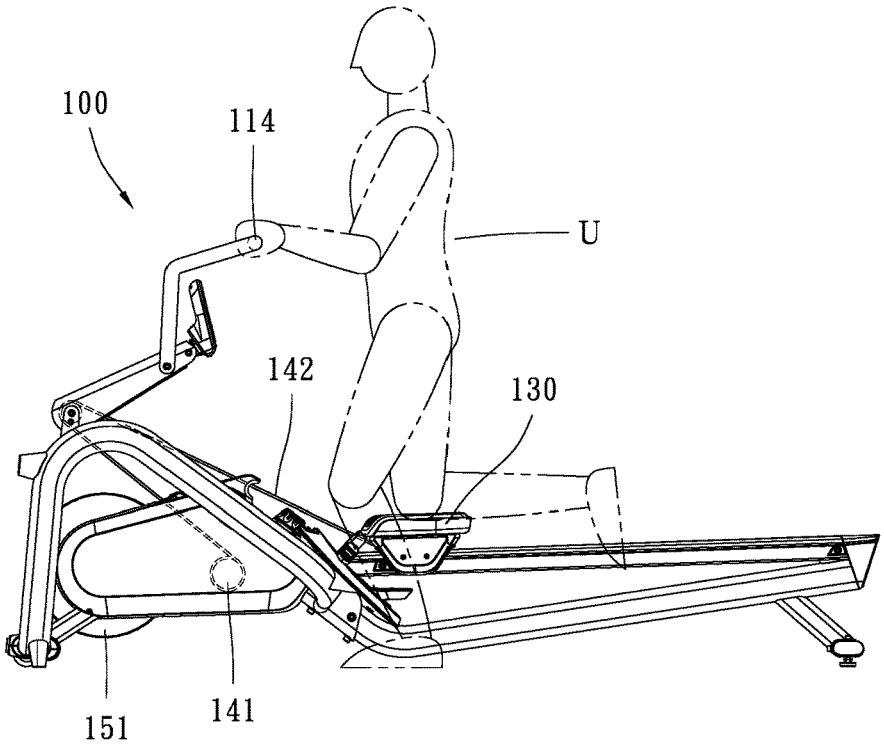
FIG. 3A and FIG. 3B illustrate the user performing a second exercise with the exercise apparatus in the first preferred embodiment.
Figure 3B:
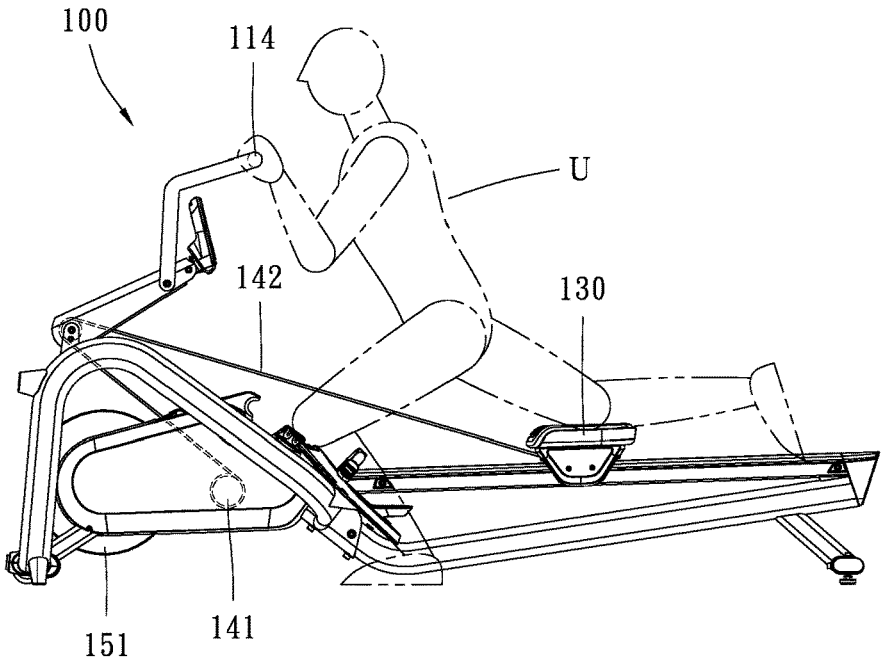

FIG. 3A and FIG. 3B illustrate that a user U performs a second exercise through the aforementioned exercise apparatus 100. When performing the second exercise, the user U faces frontward and stands at one side of the exercise apparatus 100 at a position corresponding to the front end of the guide rail, and two hands grasp the gripping portions 114 at the top of the frame, and keeping the outside leg (or supporting leg hereinafter, as the left leg in the figure) standing on the ground, and letting the knee of the inside leg (or training leg hereinafter, as the right leg in the figure) rest on the top surface of the sliding seat 130, as shown in FIG. 3A. Then, keep the hands holding the gripping portions 114 and lower the body's center of gravity, bending the knee of the supporting leg while extending the training leg backward to push the sliding seat 130 via the knee for a suitable distance, as shown in 3B. If necessary, maintain the position as shown in FIG. 3B for a suitable period of time, and then return to the position as shown in FIG. 3A in opposite action. Above movement can be repeated if necessary. The user can also move to the other side of the exercise apparatus 100 and change for the other leg to perform the exercise. In the case of such movement, if the exercise resistance is adjusted to a relatively low level, it is able to perform stretching exercise especially for the thigh of the training leg. If the exercise resistance is adjusted to a moderate level, and repeating above movement in a relatively faster frequency, it is able to perform the whole body aerobic exercise. If the exercise resistance is adjusted to a relatively high level, it is able to perform weight training especially for the training leg.

Figure 4A:
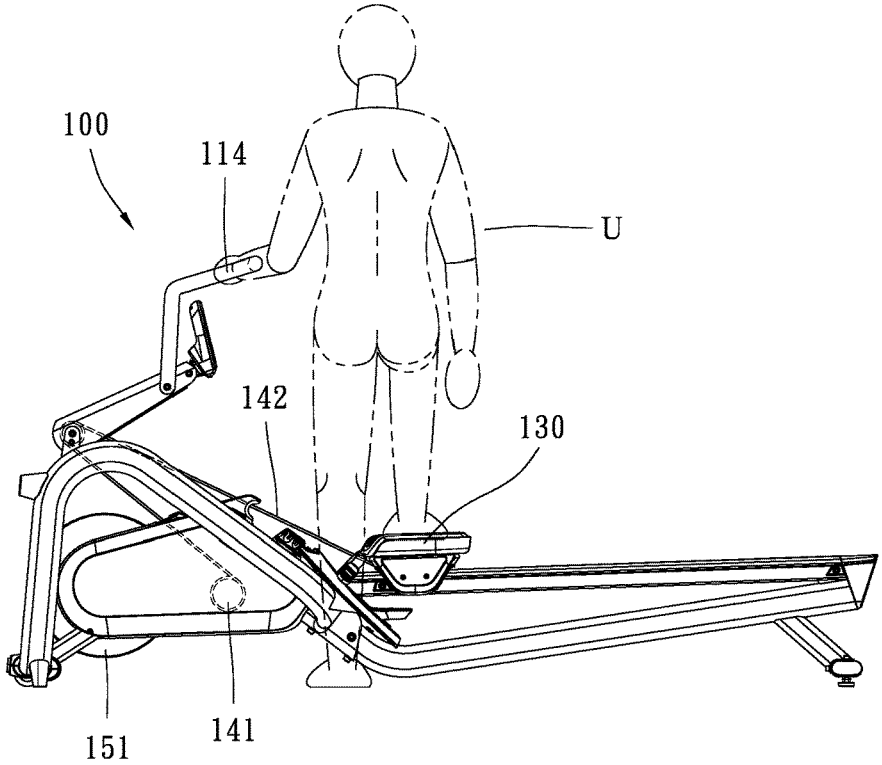
FIG. 4A and FIG. 4B illustrate the user performing a third exercise with the exercise apparatus in the first preferred embodiment.
Figure 4B:
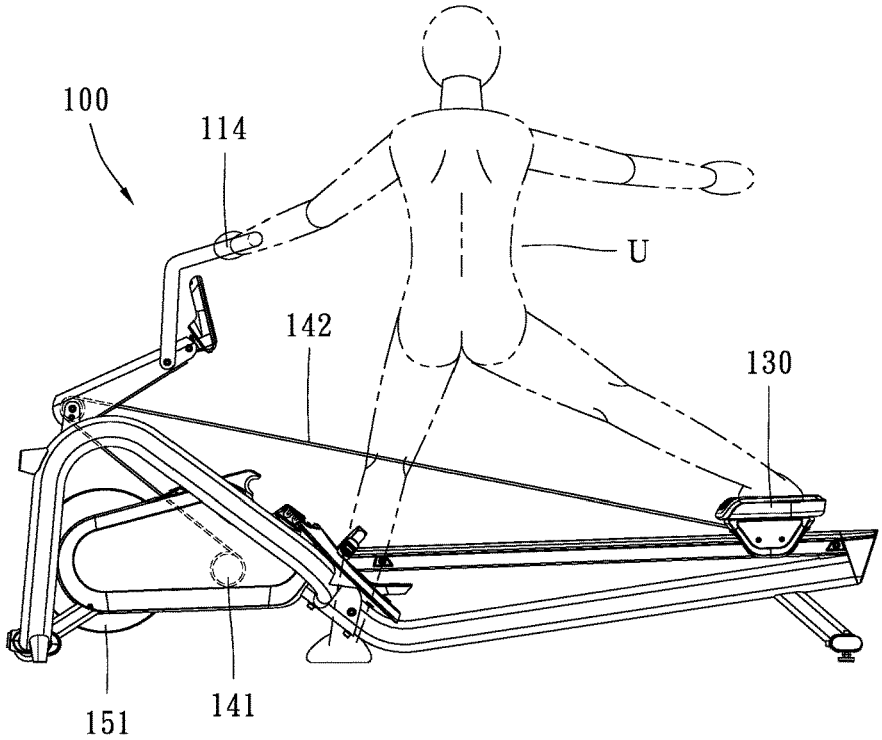

FIG. 4A and FIG. 4B illustrate that a user U performs a third exercise through the aforementioned exercise apparatus 100. When performing the third exercise, the user U stands at one side of the exercise apparatus 100 (e.g. the left side in the figure) at a position corresponding to the front end of the guide rail, facing toward the exercise apparatus 100, grasping the gripping portion 114 with one hand relatively near the front end of the exercise apparatus 100 (e.g. the left hand), and then lift one leg relatively near the rear end of the exercise apparatus 100 (or training leg hereinafter, as the right leg in the figure) and step on the top surface of the sliding seat 130, as shown in FIG. 4A. Then, keep one hand holding one of the gripping portions 114, and push the sliding seat 130 to slide backward by the foot of the training leg until the training leg is fully stretched, as shown in FIG. 4B; maintain the position as shown in FIG. 4B for a suitable period of time, and then return to the position as shown in FIG. 4A in opposite action. Repeat above movement if necessary, and it is able to stand on the other side of the exercise apparatus 100 to perform such movement for the other leg. During exercising, the sliding seat 130 continues to be pushed forward by the cord 142, so that the user is able to slowly increase the stretching angle of the training leg and easily return to the initial position. This exercise is mainly used for stretching and training the thigh muscle.

Figure 5A:
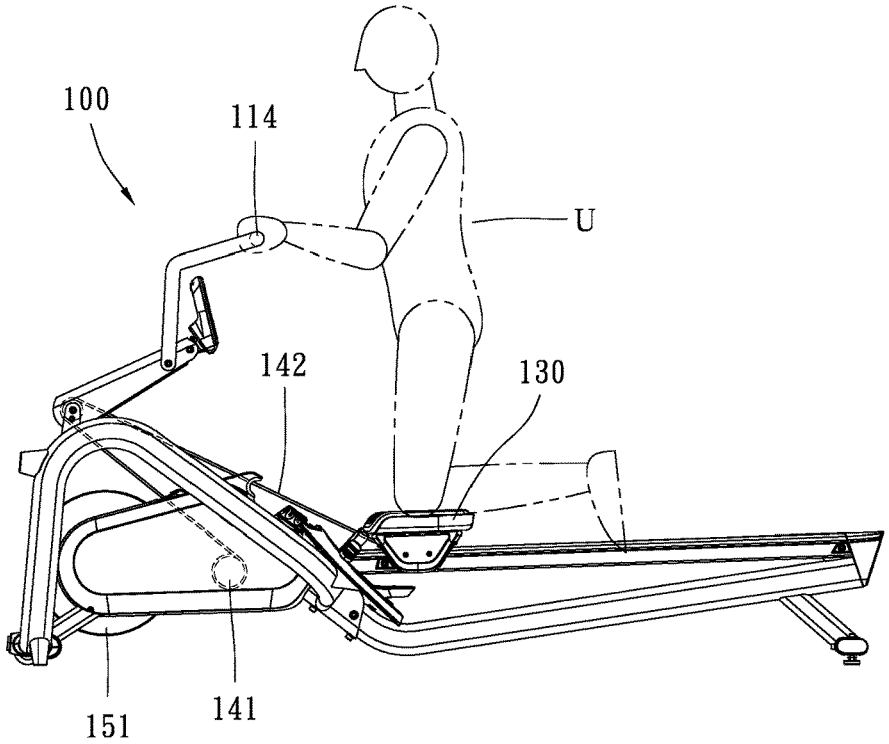
FIG. 5A and FIG. 5B illustrate the user performing a fourth exercise with the exercise apparatus in the first preferred embodiment.
Figure 5B:
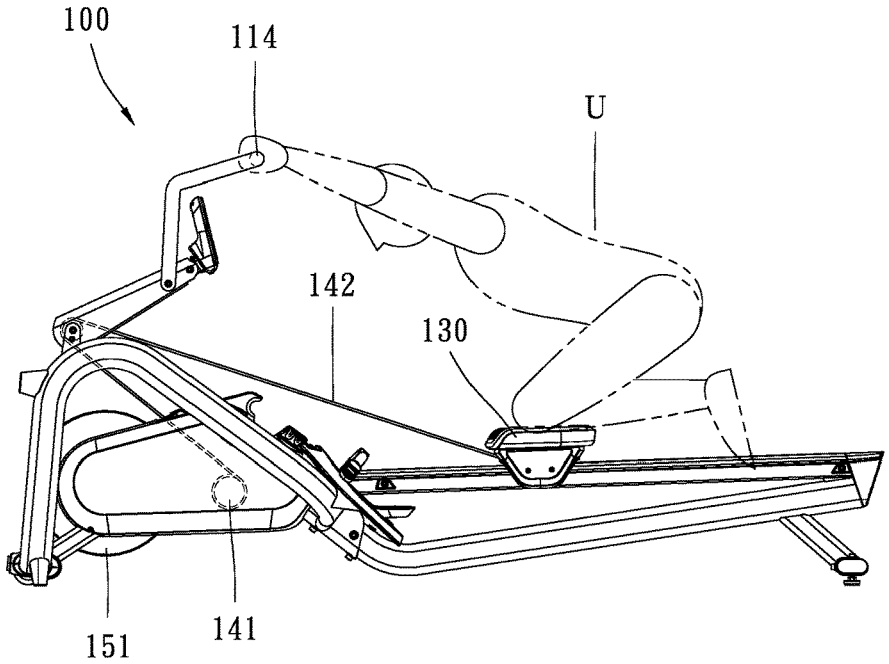

FIG. 5A and FIG. 5B illustrate that a user U performs a fourth exercise through the aforementioned exercise apparatus 100. When performing the fourth exercise, the user U faces frontward and grasps the gripping portions 114 with two hands, two knees rest on the sliding seat 130, and the user's back and thighs are straight, as shown in FIG. 5A. Then, keep two hands holding the gripping portions 114, push chest downward and lower buttocks toward the feet, stretch arms to push the body backward and move the sliding seat 130 backward for extension stretch, as shown in FIG. 5B. Then, maintain the position as shown in FIG. 5B for a suitable period of time, and then return to the position as shown in FIG. 5A in opposite action. Repeat above movement if necessary for shoulder extension stretch.

As mentioned previously, the exercise apparatus of the present invention not only allows the user to perform a typical rowing exercise, but also allows the user to perform other exercises so as to provide various exercise modes for training different body parts to achieve a better fitness effect. Besides, the exercise apparatus 100 of the present invention still retains the main structure and the basic function of the conventional rowing exercise apparatus and generates additional functions by few structure differences, which provides the facility high cost efficiency and space efficiency. It should be noted that the exercise apparatus 100 of the present invention has only one resistance device 150 and one one-way transmission mechanism 160. In other words, no matter performing rowing exercise or other exercises, both the rotating member 151 driven by the handle 143 and the rotating member 151 driven by the sliding seat 130 are the same resistance component (e.g. the flywheel) of the same resistance device, and the power applied by the user to the handle 143 and the sliding seat 130 will eventually transmit to the aforementioned rotating member 151 via the same transmission path. Furthermore, in the preferred embodiment, the cord receiving device 140 has only one cord system, namely, the cord 142 for connecting the sliding seat 140 and the cooperated cord winder 143 and the elastic member for performing other exercises is same as the cord 142 for connecting the handle 143 and the cooperated cord winder 141 and the elastic member for performing the rowing exercise. Therefore, the aforementioned exercise apparatus 100 has advantage of simple structure and low cost.

Figure 6:
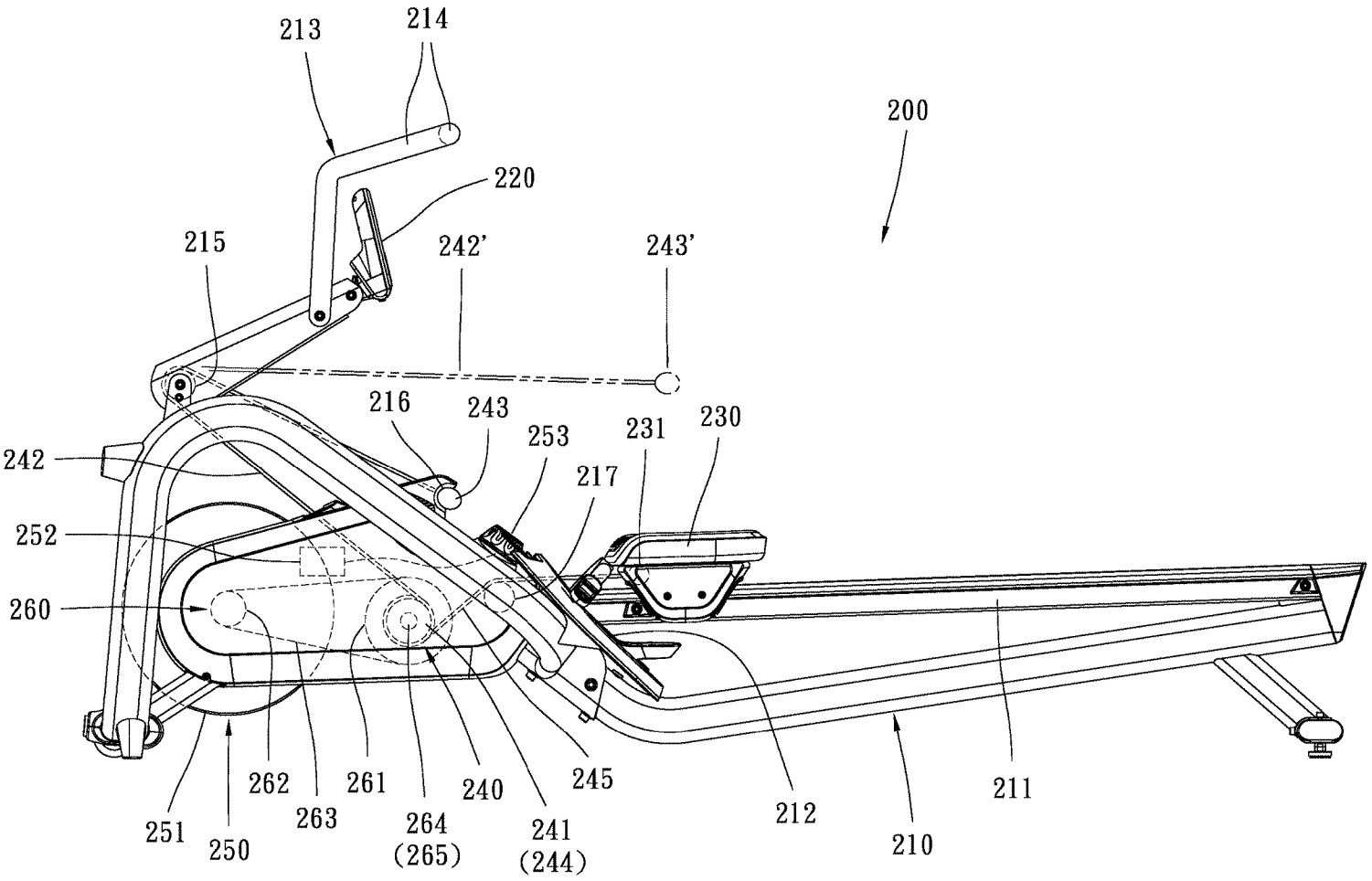
FIG. 6 is a side view of an exercise apparatus in accordance with a second preferred embodiment of the present invention.

Referring to FIG. 6, an exercise apparatus 200 in accordance with a second preferred embodiment of the present invention is similar to the exercise apparatus of the first embodiment, which comprises a frame 210, an interface device 220, a sliding seat 230, a cord receiving device 240, a resistance device 250 and a one-way transmission mechanism 260. The exercise apparatus 200 of the second embodiment is similar to the exercise apparatus 100 of the first embodiment, except that the cord receiving device 240 has two cord systems. In detail, the cord receiving device 240 has a first cord winder 241, a second cord winder 244, a first elastic member (not shown), a second elastic member (not shown), a first cord 242 and a second cord 245. The first cord winder 241, the first elastic member and the first cord 242 respectively correspond with the cord winder 141, the elastic member and the cord 142 in the first embodiment, namely the cord winder 241 is pivotally mounted to the frame 210. The first elastic member is mounted between the frame 210 and the first cord winder 241. The first cord 242 has a first end connected to the first cord winder 241. The second cord winder 244 is also pivotally mounted to the frame 210 and coaxial with the first cord winder 241, but the two cord winders 241, 244 each can be rotated in both directions. Similarly, the second elastic member is mounted between the frame 210 and the second cord winder 244. The second elastic member could be deformed by rotational movement of the second cord winder 244 in the first rotational direction (the counterclockwise direction in the figure) to accumulate an elastic force, and such elastic force causes the second cord winder 244 to rotate in the second rotational direction (the clockwise direction in the figure). The second cord 245 has a first end connected to the second cord winder 244 and a second end connected to the sliding seat 230. The second cord 245 has a partial length of the second cord 245 previously wound around the outer periphery of the second cord winder 244 in accordance with the first rotational direction and extending rearward around a guiding pulley 217 for guiding the direction and then continuing to extend rearward, and finally the second end of the second cord 245 is connected to the connecting portion 231 of the sliding seat 230. Therefore, the second cord 245 is shown to be extended forward from the sliding seat 230 to the second cord winder 244 and the sliding seat 230 is pulled by the second cord 245 to stop at the front end of the guide rail 211 when no external force is applied. On the other hand, the first cord 242 has a second end connected to a handle 243 for allowing the user to grasp. The handle 243 has no need to be detached from the first cord 242, and the first cord 242 has no need to connect the sliding seat 231.

Furthermore, in the preferred embodiment, the one-way transmission mechanism 260 has a first driving wheel 261, a second driving wheel 262, a driving belt 263, a first one-way bearing 264 and a second one-way bearing 265. The first driving wheel 261, the second driving wheel 262 and the driving belt 263 are the same as the first embodiment. The first one-way bearing 264 is mounted between the first cord winder 241 and the first driving wheel 261, so that the first cord winder 241 is able to rotate freely with respect to the first driving wheel in the second rotational direction and is unable to rotate in the first rotational direction. Similarly, the second one-way bearing 265 is mounted between the second cord winder 244 and the first driving wheel 261, so that the second cord winder 244 is able to rotate freely only in the second rotational direction and is unable to rotate in the first rotational direction.

Therefore, when pulling the handle 243 backward by an external force, the first cord 242 is pulled to drive the first cord winder 244 to rotate in the first rotational direction and the power is able to transmit to the rotating member 251 of the resistance device 250 via the one-way transmission mechanism 260 to push the rotating member 251 to rotate in the predetermined rotational direction. In contrast, when pulling the sliding seat 230 backward by an external force, the second cord 245 is pulled to drive the second cord winder 244 to rotate in the first rotational direction and the power is able to transmit to the rotating member 251 of the resistance device 250 via the one-way transmission mechanism 260 to push the rotating member 251 to rotate in the predetermined rotational direction as well. The rotating member 251 may be driven to rotate by pulling the handle 243 or pushing the sliding seat, or both.

Figure 7:
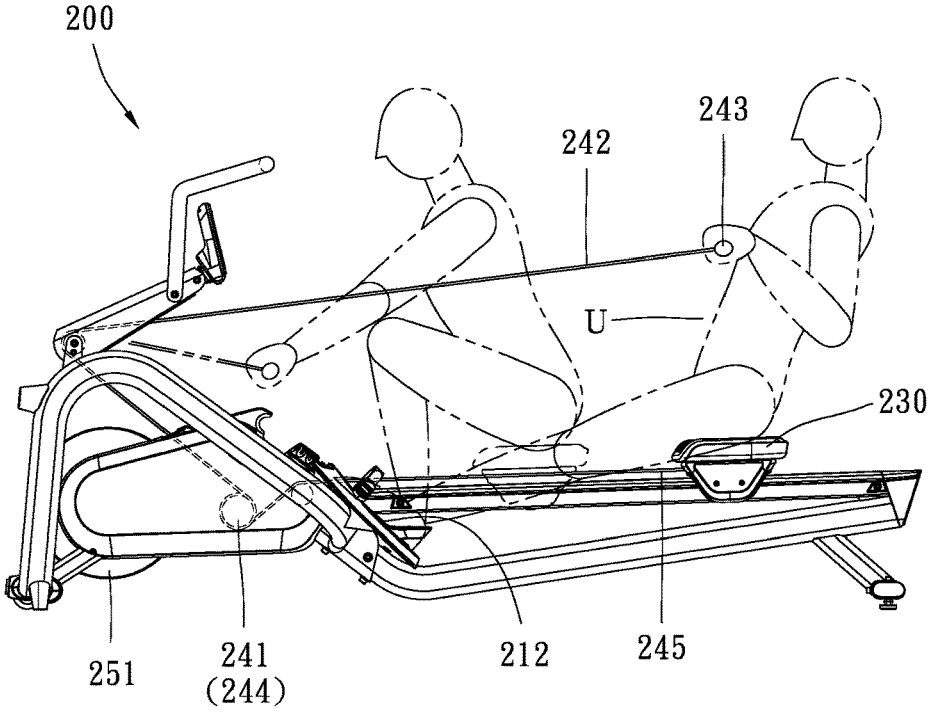
FIG. 7 illustrates the user performing the rowing exercise (first exercise) with the exercise apparatus in the second preferred embodiment.

The exercise apparatus 200 of the second embodiment also allows the user to perform rowing exercise or other exercises. FIG. 7 illustrates a user U using the exercise apparatus 200 to perform the rowing exercise. It should be noted that the second end of the second cord 245 is still connected to the sliding seat 230, so that the user needs to provide additional force against the exercise resistance to push the sliding seat 230 backward when performing the rowing exercise. In fact, the second end of the second cord 245 is detachably connected to the connecting portion 231 of the sliding seat 230, for example, the second end of the second cord 245 and the connecting portion 231 of the sliding seat 230 may be equipped with the aforementioned safety hook and connecting ring. Therefore, when performing the rowing exercise, the user can choose to connect the second end of the second cord 245 to the sliding seat 230 as shown in FIG. 7, or to selectively detach the second end of the second cord 245 from the sliding seat 230 to perform the typical rowing exercise. If the second cord 245 detached from the sliding seat 230, the second end of the second cord 245 can be positioned in a retaining portion (not shown) which is arranged on the front end of the guide rail 211 for preventing the second cord 245 from continuing to move forward.

Figure 8:
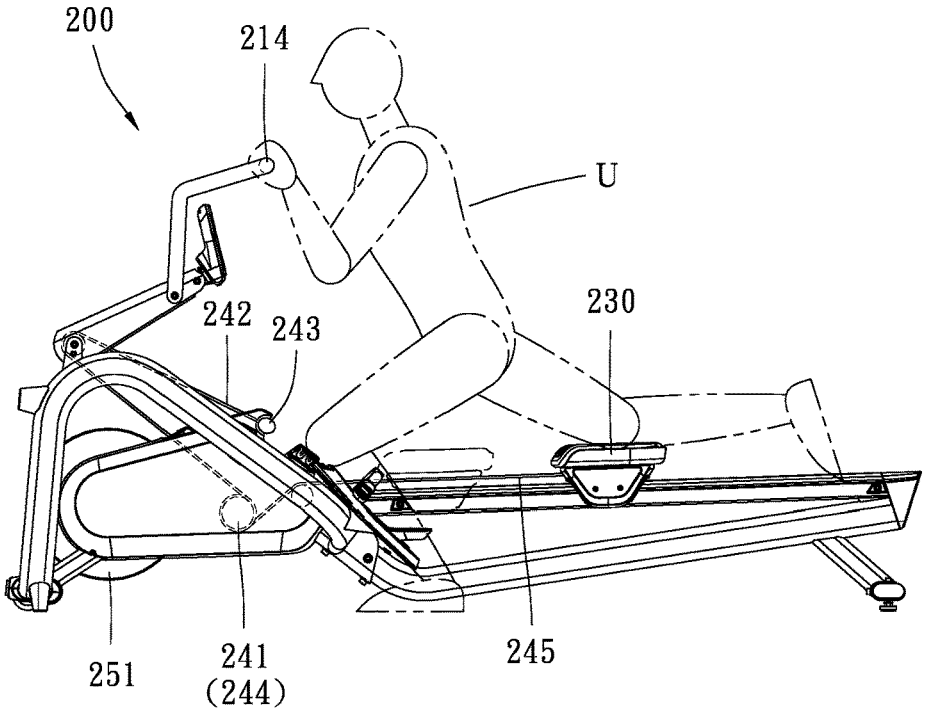
FIG. 8 illustrates the user performing the second exercise with the exercise apparatus in the second preferred embodiment.
Figure 9:
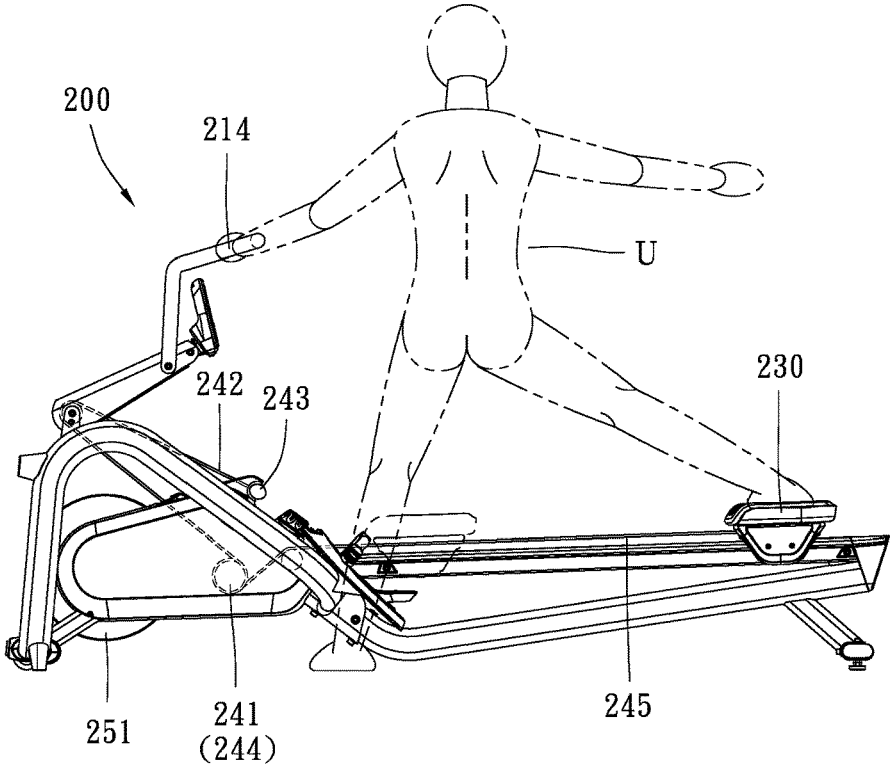
FIG. 9 illustrates the user performing the third exercise with the exercise apparatus in the second preferred embodiment.
Figure 10:
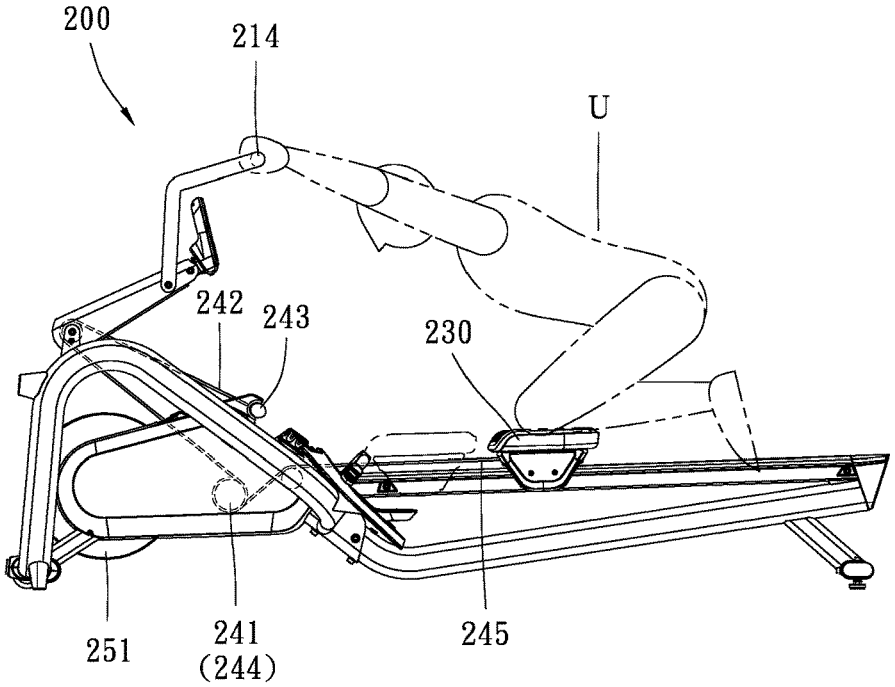
FIG. 10 illustrates the user performing the fourth exercise with the exercise apparatus in the second preferred embodiment.

FIG. 8, FIG. 9 and FIG. 10 respectively illustrate a user U using the exercise apparatus 200 of the second embodiment to perform the second exercise, the third exercise and the fourth exercise as depicted in FIGS. 3A-3B, FIGS. 4A-4B, and FIGS. 5A-5B in the first embodiment. When using the exercise apparatus 200 of the second embodiment to perform other exercises, the first cord 242 and the handle 243 are useless, and the second end of the second cord 245 is connected to the sliding seat 245 as the only one cord 142 in the first embodiment.

In the preferred embodiment, although the handle 243 and the sliding seat 230 have their own cord system, the exercise apparatus 200 has only one resistance device 250 and one one-way transmission mechanism 260 as well. In other words, no matter performing rowing exercise or other exercises, both the rotating member 251 driven by the handle 243 and the rotating member 251 driven by the sliding seat 230 are the same resistance component of the same resistance device, and the power applied by the user to the handle 143 and the sliding seat 130 will eventually transmit to the aforementioned rotating member 151 via the same transmission path.

Figure 11:
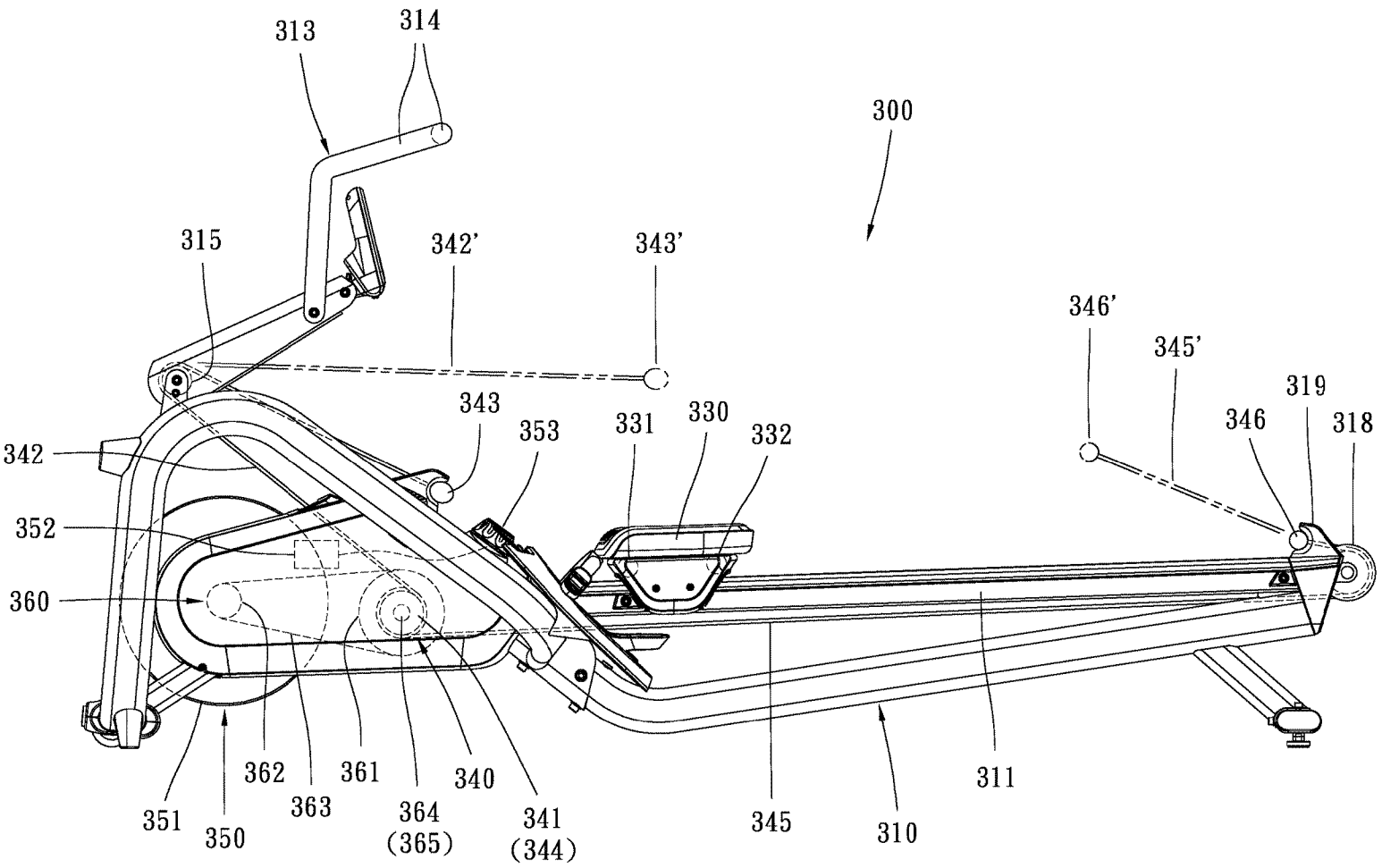
FIG. 11 is a side view of an exercise apparatus in accordance with a third preferred embodiment of the present invention.

Referring to FIG. 11, an exercise apparatus 300 in accordance with a third preferred embodiment of the present invention is similar to the exercise apparatuses of the aforementioned first and second embodiments. In the third embodiment, the cord receiving device 340 and the one-way transmission mechanism 360 are similar to that of the second embodiment, namely the cord receiving device 340 also has a first cord winder 341, a second cord winder 344, a first elastic member (not shown), a second elastic member (not shown), a first cord 342 and a second cord 345, and the one-way transmission mechanism 360 also has a first driving wheel 361, a second driving wheel 362, a driving belt 363, a first one-way bearing 364 and a second one-way bearing 365. The relationship between the aforementioned components is substantially the same as that of the corresponding component in the second embodiment, except that the second cord 345 extends rearward from the outer periphery of the second cord winder 344 and extends along the bottom side of the guide rail 311, and then extends frontward around a rear pulley 318 which is pivotally mounted at the rear end of the guide rail 311.

As shown in FIG. 11, the second cord 345 has an end member 346 defined at the second end (distal end) thereof. The end member 346 of the second cord 345 could be normally positioned in a retaining portion 319 which is disposed at the rear end of the guide rail 311 for preventing the second cord 345 from being retracted. The user can pull the distal end of the second cord 345 forward away from the retaining portion 319 and continuing away from the rear pulley 318, as the second cord 345' and the end member 346' depicted by phantom lines in FIG. 11. The distal end of the second cord 345 is detachably connected to a rear connecting portion 332 of the sliding seat 330, such that the second cord 345 is shown to be extended rearward from the sliding seat 330 to the rear pulley 318 and then extended forward around the rear pulley 318 to the second cord winder 344. On the other hand, similarly to the first embodiment, the distal end of the first cord 342 is also capable of being detachably connected to a front connecting portion 331 of the sliding seat 330.

Under this arrangement, if the first cord 342 and the second cord 345 are not connected to the sliding seat 330, the user is able to use the exercise apparatus 300 to perform the typical rowing exercise, namely sitting on the sliding seat 330 without exercise resistance and sliding backward and forward in accord with the repeating movement of pulling the first cord 342 with exercise resistance. If the distal end of the first cord 342 is connected to the front connecting portion 331 of the sliding seat 330 and the second cord 345 is not connected to the sliding seat 330 so that the sliding seat 330 drives the rotating member 351 to rotate only when the sliding seat 330 slides backward and has a tendency to move forward to reposition, the user is able to use the exercise apparatus 300 to perform the aforementioned second, third and fourth exercises. In contrast, if the distal end of the second cord 345 is connected to the rear connecting portion of the sliding seat 330 and the first cord 342 is not connected to the sliding seat 330 so that the sliding seat 330 drives the rotating member 351 to rotate only when the sliding seat 330 slides frontward and has a tendency to move backward to reposition, the user is able to use to exercise apparatus 300 to perform another exercise as mentioned below.

Figure 12A:
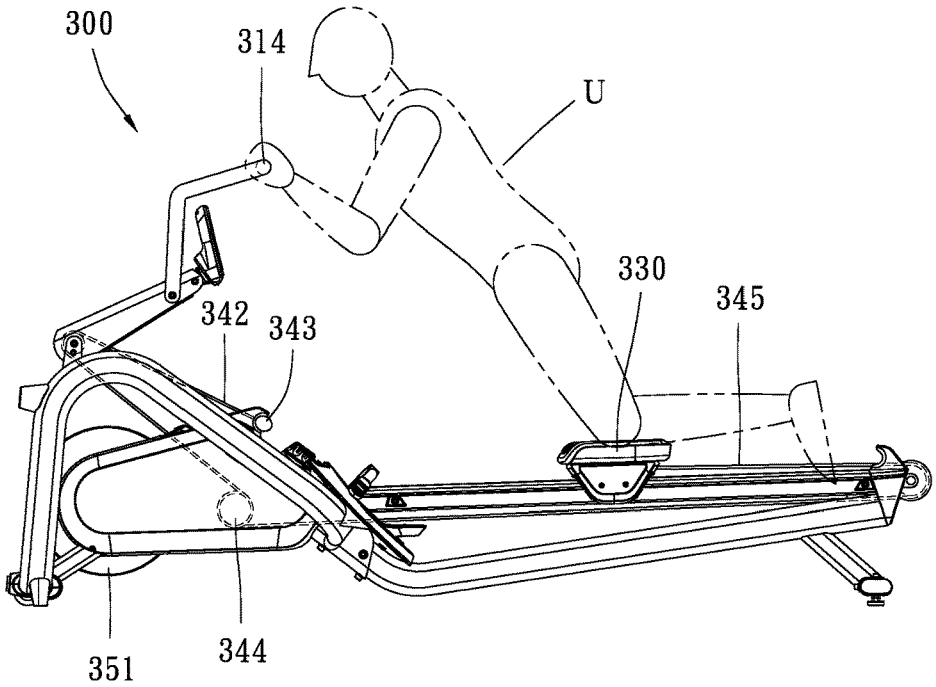
FIG. 12A and FIG. 12B illustrate the user performing a fifth exercise with the exercise apparatus in the third preferred embodiment.
Figure 12B:
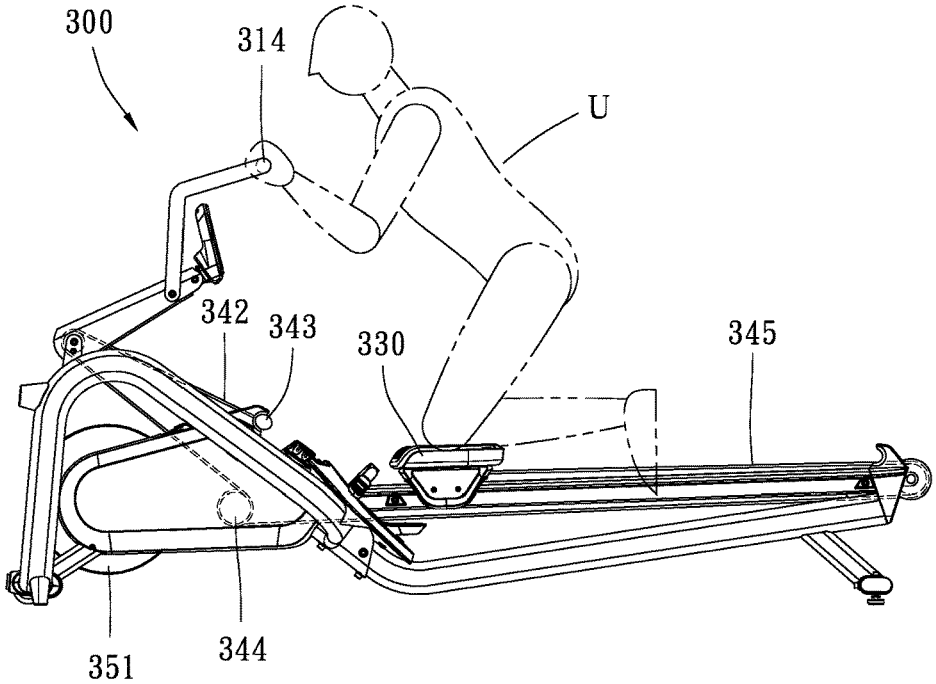

FIG. 12A and FIG. 12B illustrate that a user U performs a fifth exercise through the aforementioned exercise apparatus 300. When performing the fifth exercise, the user U faces frontward and grasps the gipping portions 314 at the front end of the frame with two hands, two knees rest on the sliding seat 330, the body is leaned forward suitably, such that the thighs and the body are substantially straight as shown in FIG. 12. Then, keep two hands holding the gripping portions 314, bend the knees to make the thighs toward the abdominals and push the sliding seat 330 frontward for a suitable distance as shown in FIG. 12B. Maintain the position as shown in FIG. 12B for a suitable period of time, and then return to the initial position as shown in FIG. 12A. Repeat above movement if necessary for training abdomen as crunch exercise. In the preferred embodiment, the guide rail 311 may have a retaining block (not shown) for allowing the user to put on the guide rail 311 at a suitable position according to individual height and physical ability to retain the sliding seat 330 for safety.

What is claimed is:

1. An exercise apparatus for allowing a user to perform rowing exercise, comprising:

a frame;

a sliding seat having at least one connecting portion, the sliding seat adapted to be moved along a movement path, the movement path defining a front end and a rear end;

a pedal set mounted on the frame for supporting the user's feet during the rowing exercise;

a cord receiving device having at least one cord winder, at least one elastic member and at least one cord, the at least one cord winder including a first cord winder, each of the at least one cord winder being rotatable in both directions with respect to the frame, the at least one elastic member including a first elastic member, each of the at least one elastic member mounted between the frame and the respective cord winder and being deformed by rotational movement of the respective cord winder in a first rotational direction to accumulate an elastic restoring force, the elastic restoring force causing the respective cord winder to rotate in a second rotational direction, the at least one cord including a first cord, each of the at least one cord having a first end and a second end, the first end connected to the respective cord winder, each cord being wrapped onto the respective cord winder as the respective cord winder is rotated in the second rotational direction, wherein the first elastic member is mounted between the frame and the first cord winder, the first end of the first cord is connected to the first cord winder;

a resistance device having a rotating member pivotally mounted to the frame for generating an exercise resistance;

a one-way transmission mechanism mounted between the cord receiving device and the rotating member of the resistance device, when the first cord winder is rotated in the first rotational direction, the one-way transmission mechanism is operable to engage with the rotating member for driving the rotating member to rotate in a predetermined rotational direction; when the first cord winder is rotated in the second rotational direction, the one-way transmission mechanism is operable to disengage from the rotating member; and a handle connected to the second end of the first cord for allowing the user to grasp during the rowing exercise;

wherein the second end of one of the at least one cord of the cord receiving device is operable to connect with the connecting portion of the sliding seat for allowing the user to perform stretching or crunch exercises; the frame has at least one gripping portion; the when the user performs stretching or crunch exercises, the user has lower limbs partially press upon the sliding seat and move with the sliding seat; when the sliding seat is slid to one end of the movement path, the sliding seat pulls the respective cord to drive the respective cord winder to rotate in the first rotational direction, and the one-way transmission mechanism is effective to transmit power to the rotating member so as to drive the rotating member to rotate in the predetermined rotational direction; the gripping portion is provided for allowing the user to grasp during stretching or crunch exercises.

2. The exercise apparatus as claimed in claim 1, wherein when the user performs stretching or crunch exercises, the second end of the first cord is detachably connected to the connecting portion of the sliding seat, and the first cord is extended forward from the sliding seat to the first cord winder, such that when the sliding seat is slid backward, the first cord is pulled to drive the first cord winder to rotate in the first rotational direction.

3. The exercise apparatus as claimed in claim 1, wherein the at least one cord winder of the cord receiving device includes a second cord winder, the at least one elastic member including a second elastic member, the at least one cord including a second cord, the second cord winder and the first cord winder being rotatable independently, the second elastic member mounted between the frame and the second cord winder, the first end of the second cord connected to the second cord winder; when the second cord winder is rotated in the first rotational direction, the one-way transmission mechanism is operable to engage with the rotating member for driving the rotating member to rotate in the predetermined rotational direction; when the second cord winder is rotated in the second rotational direction, the one-way transmission mechanism is operable to disengage from the rotating member; when the user performs stretching or crunch exercises, the user is able to choose to detachably connect the second end of the first cord or the second end of the second cord to the connecting portion of the sliding seat; when choosing the first cord connected to sliding seat, the first cord is extended forward from the sliding seat and then extended to the first cord winder, so that when the sliding seat is slid backward, the first cord is pulled to drive the first cord winder to rotate in the first rotational direction; when choosing the second cord connected to sliding seat, the second cord is extended backward from the sliding seat and then extended to the second cord winder, so that when the sliding seat is slid forward, the second cord is pulled to drive the second cord winder to rotate in the first rotational direction.

4. The exercise apparatus as claimed in claim 2, wherein the handle is detachably connected to the second end of the first cord; when the second end of the first cord is connected to the connecting portion of the sliding seat, the handle is temporarily detached from the second end of the first cord.

5. The exercise apparatus as claimed in claim 3, wherein the handle is detachably connected to the second end of the first cord; when the second end of the first cord is connected to the connecting portion of the sliding seat, the handle is temporarily detached from the second and of the first cord.

6. The exercise apparatus as claimed in claim 1, wherein the at least one cord winder of the cord receiving device includes a second cord winder, the at least one elastic member including a second elastic member, the at least one cord including a second cord, the second cord winder and the first cord winder being rotatable independently, the second elastic member mounted between the frame and the second cord winder, the first end of the second cord connected to the second cord winder; when the second cord winder is rotated in the first rotational direction, the one-way transmission mechanism is operable to engage with the rotating member for driving the rotating member to rotate in the predetermined rotational direction; when the second cord winder is rotated in the second rotational direction, the one-way transmission mechanism is operable to disengage from the rotating member; when the user performs stretching or crunch exercises, the second end of the second cord is connected to the connecting portion of the sliding seat, so that when the sliding seat is slid to one end of the movement path, the second cord is pulled to drive the second cord winder to rotate in the first rotational direction.

7. The exercise apparatus as claimed in claim 6, wherein when the user performs stretching or crunch exercises, the second cord is extended forward from the sliding seat and then extended to the second cord winder, so that when the sliding seat is slid backward, the second cord is pulled to drive the second cord winder to rotate in the first rotational direction.

8. The exercise apparatus as claimed in claim 7, the second end of the second cord is detachably connected to the connecting portion of the sliding seat.

9. The exercise apparatus as claimed in claim 6, wherein when the user performs stretching or crunch exercises, the second end of the second cord is detachably connected to the connecting portion of the sliding seat, and the second cord is extended backward from the sliding seat and then extended to the second cord winder, so that when the sliding seat is slid forward, the second cord is pulled to drive the second cord winder to rotate in the first rotational direction; and when the user performs the rowing exercise, the second end of the second cord is detached from the connecting portion of the sliding seat.

10. The exercise apparatus as claimed in claim 3, wherein the one-way transmission mechanism has a first driving wheel, a second driving wheel, a first one-way bearing and a second one-way bearing; the first driving wheel is pivotally mounted to the frame, and the first driving wheel, the first cord winder and the second cord winder are coaxial with one another; the second driving wheel is coaxially connected to the rotating member, and rotation of the first driving wheel drives the second driving wheel to rotate with a higher rotational speed; the first one-way bearing is mounted between the first cord winder and the first driving wheel, such that the first cord winder is able to rotate relative to the first driving wheel in the second rotational direction and unable to rotate in the first rotational direction; and the second one-way bearing is mounted between the second cord winder and the first driving wheel, such that the second cord winder is able to rotate relative to the first driving wheel in the second rotational direction and unable to rotate in the first rotational direction.

11. The exercise apparatus as claimed in claim 6, wherein the one-way transmission mechanism has a first driving wheel, a second driving wheel, a first one-way bearing and a second one-way bearing; the first driving wheel is pivotally mounted to the frame, and the first driving wheel, the first cord winder and the second cord winder are coaxial with one another; the second driving wheel is coaxially connected to the rotating member, and rotation of the first driving wheel drives the second driving wheel to rotate with a higher rotational speed; the first one-way bearing is mounted between the first cord winder and the first driving wheel, such that the first cord winder is able to rotate relative to the first driving wheel in the second rotational direction and unable to rotate in the first rotational direction; and the second one-way bearing is mounted between the second cord winder and the first driving wheel, such that the second cord winder is able to rotate relative to the first driving wheel in the second rotational direction and unable to rotate in the first rotational direction.

12. The exercise apparatus as claimed in claim 1, wherein the rotating member is a flywheel, the resistance device further comprising a resistance adjusting mechanism configured for allowing the user to adjust rotational resistance of the rotating member.

13. An exercise apparatus for allowing a user to perform rowing exercise, comprising:

a frame;

a sliding seat having at least one connecting portion, the sliding seat adapted to be moved along a movement path, the movement path defining a front end and a rear end;

a pedal set mounted on the frame for supporting the user's feet during the rowing exercise;

a cord receiving device having a first cord winder, a first elastic member, and a first cord, the first cord winder being rotatable in both directions with respect to the frame, the first elastic member mounted between the frame and the first cord winder, the first elastic member being deformed by rotational movement of the first cord winder in a first rotational direction to accumulate an elastic restoring force for causing the first cord winder to rotate in a second rotational direction, the first cord having a first end connected to the cord winder and a second end, the first cord being wrapped onto the first cord winder as the first cord winder is rotated in the second rotational direction;

a resistance device having a rotating member pivotally mounted to the frame for generating an exercise resistance; and a one-way transmission mechanism arranged between the cord receiving device and the rotating member of the resistance device, the one-way transmission mechanism is operable to engage with the rotating member for driving the rotating member to rotate in a predetermined rotational direction when the first cord winder is rotated in the first rotational direction, the one-way transmission mechanism is operable to disengage from the rotating member when the first cord winder is rotated in the second rotational direction;

wherein the second end of the first cord is operable to connect with a handle for allowing the user to grasp during the rowing exercise or to connected with the connecting portion of the sliding seat for allowing the user to perform stretching or crunch exercises.

14. The exercise apparatus as claimed in claim 13, wherein the frame has at least one gripping portion for allowing the user to grasp during stretching or crunch exercises.

15. The exercise apparatus as claimed in claim 13, wherein the cord receiving device further comprises a second cord winder, a second elastic member, and a second cord, the second cord winder and the first cord winder being rotatable in both directions independently, the second elastic member mounted between the frame and the second cord winder, the second elastic member being deformed by rotational movement of the second cord winder in a first rotational direction to accumulate an elastic restoring force for causing the second cord winder to rotate in a second rotational direction, the second cord having a first end connected to the cord winder and a second end, the second cord being wrapped onto the second cord winder as the second cord winder is rotated in the second rotational direction; when the second cord winder is rotated in the first rotational direction, the one-way transmission mechanism is operable to engage with the rotating member for driving the rotating member to rotate in the predetermined rotational direction; when the second cord winder is rotated in the second rotational direction, the one-way transmission mechanism is operable to disengage from the rotating member; when the user performs stretching or crunch exercises, the user is able to choose to detachably connect the second end of the first cord or the second end of the second cord to the connecting portion of the sliding seat; when choosing the first cord connected to sliding seat, the first cord is extended forward from the sliding seat and then extended to the first cord winder, so that when the sliding seat is slid backward, the first cord is pulled to drive the first cord winder to rotate in the first rotational direction; when choosing the second cord connected to sliding seat, the second cord is extended backward from the sliding seat and then extended to the second cord winder, so that when the sliding seat is slid forward, the second cord is pulled to drive the second cord winder to rotate in the first rotational direction.

16. An exercise apparatus for allowing a user to perform rowing exercise, comprising:

a frame;

a sliding seat having at least one connecting portion, the sliding seat adapted to be moved along a movement path, the movement path defining a front end and a rear end;

a pedal set mounted on the frame for supporting the user's feet during the rowing exercise;

a cord receiving device having first and second cord winders, first and second elastic members, and first and second cords, the first and second cord winders being rotatable in both directions with respect to the frame, the first and second elastic members mounted between the frame and the respective cord winders, the first and second elastic members being deformed by rotational movement of the respective cord winders in a first rotational direction to accumulate respective elastic restoring forces for causing the first and second cord winders to rotate in a second rotational direction, both the first and second cords having a first end connected to the respective cord winder and a second end, the first cord being wrapped onto the first cord winder as the first cord winder is rotated in the second rotational direction, the second cord being wrapped onto the second cord winder as the second cord winder is rotated in the second rotational direction;

a resistance device having a rotating member pivotally mounted to the frame for generating an exercise resistance;

a one-way transmission mechanism arranged between the two cord receiving device and the rotating member of the resistance device, the one-way transmission mechanism is operable to engage with the rotating member for driving the rotating member to rotate in a predetermined rotational direction when the first cord winder or the second cord winder is rotated in the first rotational direction, the one-way transmission mechanism is operable to disengage from the rotating member when the first cord winder or the second cord winder is rotated in the second rotational direction; and a handle connected to the second end of the first cord for allowing the user to grasp during the rowing exercise;

wherein the second end of the second cord of the cord receiving device is operable to connect with the connecting portion of the sliding seat for allowing the user to perform stretching or crunch exercises and the frame has at least one gripping portion for allowing the user to grasp during the stretching, or crunch exercises, when performing the stretching or crunch exercises, the second cord is extended backward from the sliding seat and then extended to the second cord winder, so that when the sliding seat is slid forward, the second cord is pulled to drive the second cord winder to rotate in the first rotational direction.

* * * * *